United States Patent [19]

Marti

[11] 4,170,238

[45] Oct. 9, 1979

[54] SMOKER'S TOOL INCLUDING A TOBACCO-PRESSER MEANS FOR PRESSING DOWN LIGHTENED TOBACCO IN A PIPE

[76] Inventor: Herbert Marti, Unterrutistrasse 1, Langnau am Albis, Switzerland

[21] Appl. No.: 806,928

[22] Filed: Jun. 15, 1977

[30] Foreign Application Priority Data

Jun. 25, 1976 [DE] Fed. Rep. of Germany ..... 2628740

[51] Int. Cl.[2] ..... A24F 9/02

[52] U.S. Cl. ..... 131/243; 131/247

[58] Field of Search ..... 131/247, 177, 184, 243, 131/170, 245, 247; 30/162

[56] References Cited

U.S. PATENT DOCUMENTS 2,894,515 7/1959 Wismer, Jr. ..... 131/243

FOREIGN PATENT DOCUMENTS 58497 3/1891 Fed. Rep. of Germany ..... 131/247

1349418 12/1963 France ..... 131/247

203754 3/1939 Switzerland ..... 131/247

*Primary Examiner*—Stephen C. Pellegrino

*Attorney, Agent, or Firm*—Diller, Ramik & Wight

[57] ABSTRACT

A smoker's tool including a tobacco-presser means for pressing down the lighted tobacco arranged in a pipe-bowl, comprising a housing means, whereby said tobacco presser means includes a punch means which is movable between an operative position and an inoperative position, whereby said housing means is arranged to be opened and closed, said punch means in its inoperative position being arranged within said housing means, which housing means in its opened position releases said punch means, whereby said punch means is telescopically guided. The punch means is supported to glide freely and in its inoperative position interlocked with said housing means.

31 Claims, 7 Drawing Figures

Fig. 1
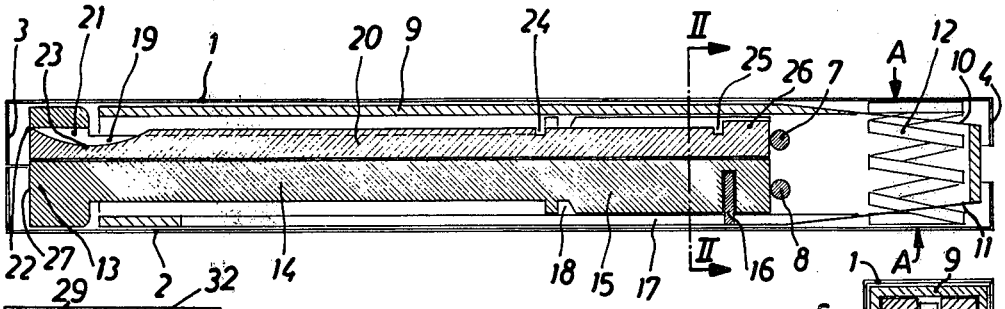
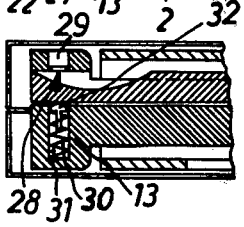
Fig. 7
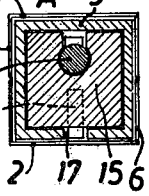
Fig. 2
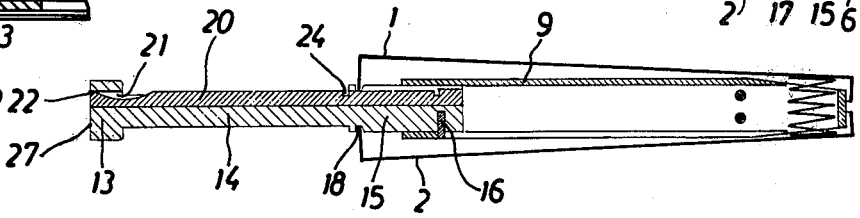
Fig. 3
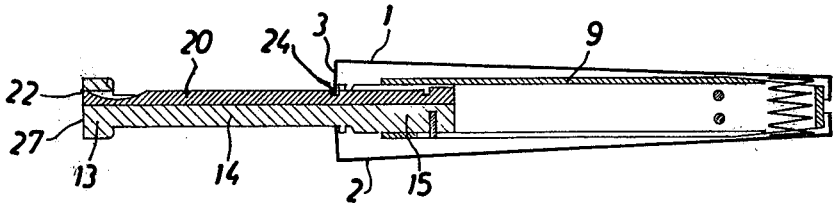
Fig. 4
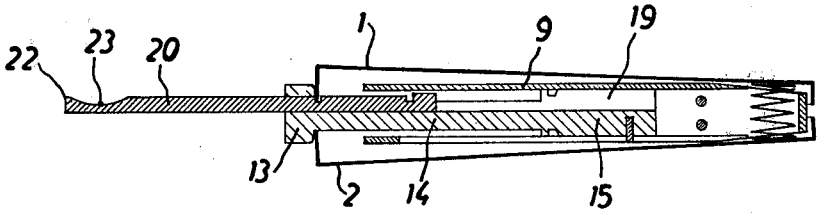
Fig. 5
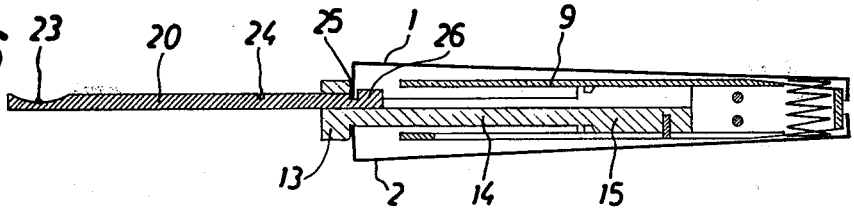
Fig. 6

SMOKER'S TOOL INCLUDING A TOBACCO-PRESSER MEANS FOR PRESSING DOWN LIGHTENED TOBACCO IN A PIPE

BACKGROUND OF THE INVENTION

1. Field of the Invention

The present invention relates to a smoker's tool including a tobacco-presser means for pressing down the lighted tobacco arranged in a pipe-bowl, comprising a housing means and a tobacco-presser means including a punch means which is movable between an operative position and an inoperative position, whereby said housing means is arranged to be opened and closed, said punch means in its inoperative position being arranged within said housing means, which housing means in its opened position releases said punch means, whereby said punch means is telescopically guided.

2. Description of the Prior Art

In the German utility model 7 106 773 there is disclosed a smoker's tool including a tobacco-presser having a punch which is telescopically guided and in its inoperative or rest position is arranged within a housing or casing. This punch is movably arranged such that it can be slid out of said housing by overcoming a restoring force of a spring acting on said punch.

However when pressing down the tobacco arranged in the pipe bowl by means of mentioned smoker's tool the operator must continuously depress a push-button with one of his fingers by acting against a restoring force of a spring acting onto the punch in order to maintain the punch in its operating position. Such handling of the smoker's tool is uncomfortable, troublesome and tiring. In addition there exists the risk or hazard that if the finger of the operator involuntarily slides off the push-button, the punch suddenly jumps or springs back into the housing. Thus the punch suffers a sharp acceleration followed by a sharp deceleration such that particles of tobacco and ashes which adhere to the punch get thrown off or catapulted off and soil the surroundings.

Furthermore, in the inoperative position of the punch its face or front surface is in no way covered. Although said front surface is sunk by a small margin within its housing, this front surface will nevertheless soil objects penetrating the forward aperture of said housing. Such objects can be e.g. a fold of the inner lining of a pocket in which the smoker's tool is carried or can be other objects a person carries along in his pocket.

Furthermore, said punch is in its rest or inoperative position not secured against sliding and emerging out of its housing. The punch will immediately emerge out of the housing when involuntarily a pressure gets exerted onto the pushing rod, such as when executing a sudden involuntary move of the body of a person or when dressing or undressing such as taking a jacket off or putting a jacket on. Such pressure can easily overcome the restoring force of the restoring spring such that the punch emerges from the housing.

SUMMARY OF THE INVENTION

Hence, it is a general object of the invention to provide an improved smoker's tool including a tobacco-presser means for pressing down lighted tobacco in a pipe, whereby the punch of the presser means is in its inoperative position completely encased in a housing and in its operative position interlocked with its housing.

A further object is to provide an improved smoker's tool comprising a punch which is supported such that it can slide freely and in its operative position interlocked with its housing.

A further object is to provide a punch which is supported within a sleeve-like member.

A further object is to provide a housing comprising two spreadable casing members, each being pivotably mounted to the housing at a fulcrum point and to provide a spring means biassing said two casing members in a closed position.

A further object is to provide a smoker's tool, whereby each of said two casing members has the form of an elongated, rectangular shell comprising a front and a rear end wall and two longitudinal walls, and whereby the rear end wall is smaller in height compared with the front end wall and thereat abutting portions of said longitudinal walls and whereby the height of the longitudinal walls decreases from the fulcrum point of each of said covering members towards said rear end wall.

A further object is to provide an integral tobacco-presser means comprising a head, a shaft and a thereon abutting guide section, whereby said guide section is guided within a sleeve.

A further object is to provide a guide section comprising at least one recess, into which recess a projection of one of said casing members lockingly engages when the tobacco-presser means is in its operative position.

A further object is to provide an improved smoker's tool, whereby said recess is a groove and said projection of said casing member is its front end wall.

A further object is to provide an improved smoker's tool comprising a sleeve member having a longitudinal slot and comprising a guiding section having a pin, said pin engaging said longitudinally extending slot in order to limit the longitudinal travel of the tobacco-presser.

A further object is to provide a smoker's tool including a guide section and a shaft and both comprising a longitudinally extending groove for receipt of a spindle-like pipe-cleaner, which spindle penetrates an opening provided in the head portion of the tobacco-presser and ends flush with the front face of said head portion at the operational position of said tobacco-presser as well as in the inoperational position thereof.

A further object is to provide a smoker's tool comprising a guiding section having a cross-sectional area which is larger than the cross-sectional area of the shaft such as to provide a shoulder.

BRIEF DESCRIPTION OF THE DRAWINGS

The present invention will be more fully understood by reference to the following detailed description thereof, when read in conjunction with the attached drawing and wherein:

FIG. 1 is a cross-sectional view of a smoker's tool in accordance with the invention and in its inoperational or rest position, FIG. 2 is a section along lines II—II of FIG. 1, FIG. 3 is a view similar to the view of FIG. 1 of the smoker's tool of FIG. 1 shown in the operational position for pressing down tobacco in a pipe bowl, FIG. 4 is a view similar to the view of FIG. 1 and showing the smoker's tool in an intermediary position, FIG. 5 is a view similar to the view of FIG. 1 of a smoker's tool, whereby its pipe-cleaner spindle is arranged in a first cleaning position, FIG. 6 is a view similar to the view of FIG. 1 of a smoker's tool, whereby its pipe-cleaner spindle is arranged in a second, advanced cleaning position, and FIG. 7 is a view of a part of the smoker's tool shown in FIG. 1 showing the front section in a larger scale and more in detail.

DETAILED DESCRIPTION OF THE PREFERRED EMBODIMENT

In FIG. 1 there is shown a smoker's tool including a housing, which housing comprises a first encasing body 1 and a second encasing body 2. Both said encasing bodies 1, 2 are identical structures and thus in the following only the encasing body 1 is described in detail. The encasing body 1 is an elongated rectangular shell comprising a front end wall 3 and a rear end wall 4 as well as two side walls 5 and 6 extending parallel to one another. The rear end wall 4 has a lower height than the front end wall 3.

The first encasing body 1 is by means of a pivot pin 7 pivotably connected to a sleeve 9 and the second encasing body 2 is by means of a pivot pin 8 pivotably connected to the same sleeve 9. The pivot pins 7, 8 are bolts, by means of which the encasing bodies are releaseably mounted to the sleeve 9. According to the preferred embodiment said pivot pins 7, 8 are rivets and according to a further embodiment they are each provided with a screw thread.

The height of the section of the side walls 5, 6 extending between the front end wall 3 and the pivot pins 7, 8, which pivot pins define a fulcrum point of the encasing bodies 1, 2, is identical to the height of the front end wall 3. Beginning at the fulcrum area the height of the side walls 5, 6 decreases in the direction towards the rear end wall 4 until said height is identical to the height of the rear end wall 4. In the same manner the outer diameter of the sleeve 9 decreases along the section originating at the fulcrum point and extending towards the rear end wall 4. If now a pressure acts on the encasing bodies 1, 2 and specifically at the section extending between the fulcrum point and the rear end walls 4 such as to urge these sections in a direction against each other, the forward sections of said encasing bodies 1, 2 will spread out whereby the front end walls 3 will separate.

The rear section of the sleeve 9 is provided with openings 10, 11. A pressure exerting spring 12 extends through said two openings 10, 11 and rests against the encasing bodies 1 and 2. Accordingly, the sections of the two bodies 1 and 2 onto which said spring 12 exerts a force are biassed away from each other and thus the encasing bodies 1, 2 are kept in a closed position as shown in FIG. 1. In this position the front end walls 3 of both said encasing bodies 1, 2 touch each other at their edges. Accordingly a completely closed housing is formed. Thus, by means of this helical pressure spring 12 the two encasing bodies 1, 2 are biassed against each other.

Within the sleeve 9 there is guided a tobacco-presser comprising a head 13, a shaft 14 and a guide section 15. At the closed position of the smoker's tool as shown in FIG. 1 said tobacco presser is completely enclosed by said encasing bodies 1, 2.

The guide section 15 is provided with a pin 16 (FIGS. 1 and 2), which pin 16 extends into a longitudinal slot 17 extending in the longitudinal direction of the sleeve 9. Furthermore, the guide section 15 is provided with a laterally extending groove 18. The cross-sectional area of the guide section 15 is larger than the cross-sectional area of the adjacent shaft 14.

Through the guide section 15 and the shaft 14 there extends a longitudinal groove 19 (see also FIG. 2). In this groove 19 there is arranged a spindle 20 forming the pipe-cleaner of the smoker's tool.

This spindle 20 extends through an opening 21 provided in the head 13 and ends flush in the front end surface, i.e. in the pressing surface of the head 13. It is to be noted that the spindle end is flush with the front end surface of the head in the inoperational position (FIG. 1) as well as in the operational position (FIG. 3) of the tobacco-presser. In order to provide a sharp edge 22 at the end of the spindle 20 such that a pipe bowl can be scraped out, said spindle is provided with a recess 23. Furthermore, the spindle 20 is provided with a first notch 24 and a second notch 25 arranged at a distance from the first notch 24, which second notch 25 is bordered by a nose 26 at the rear end of the spindle 20. This nose 26 abuts the flanks of the portion of the longitudinally extending groove 19 which extends within the guide section 15 and prevents the spindle 20 from rotating.

In FIG. 7 there is shown in greater detail the front end section of the smoker's tool. In the lower portion of the head 13 there is provided a vertically extending blind-end bore 31. In this blind-end bore 31 there is arranged a small helical pressure spring 30. This spring 30 urges a pin 32 against the spindle 30, whereby the front end section of the spindle is pressed upwards against an inner wall section of the opening 21 generating a small frictional force therebetween such that the spindle is kept in place and does not slide forwards on its own. In the upper portion of head 13 there is provided a through bore 30 in which there is arranged a plug 29. This through bore 30 is made only due to manufacturing reason, i.e. when drilling the blind-end bore 31 the drilling tool will be set onto the head 13, will drill through the upper portion of the head 13 to form the bore 28, through which bore 28 the drilling tool can extend in order to finally drill the blind-end bore.

The operation of the smoker's tool is as follows: A pressure is exerted acting in the direction of the arrows A and onto the rear end portion of both said encasing bodies 1, 2. This pressure is generated by means of the thumb and the index finger of the operator, or user, respectively, of the smoker's tool. Thereby the smoker's tool is held by said two fingers that it extends about along a vertical line, i.e. such that the head 13 faces downwards. Because now due to the force exerted at A the encasing bodies 1, 2 will be spread and the front end walls 3 therefrom separate and move away from each other. Conclusively, the tobacco-presser due to his dead weight begins to slide in the sleeve 9 and exits the housing. This sliding movement stops as soon as the pin 16 abuts the end of the longitudinally extending groove 17 of the sleeve (see FIG. 3). The spindle 20 which extends within the longitudinal groove 9 of the shaft 14 and the guide section 15 will be carried along due to the frictional forces acting between spindle 20 and longitudinal groove 19 which are generated due to the biassing force of the helical pressure spring 30.

If now pin 16 abuts the end of the longitudinal slot such as mentioned above, the pressure force A gets released and thus by action of spring 12 the end walls 3 are urged together. Thereby the end wall 3 of the lower, second encasing body enters and locks into the groove 18 provided in the guide section 15. Accordingly, the tobacco-presser is locked and secured to the housing and cannot slide back when pressing down the tobacco arranged in the pipe bowl. At the same time the front end wall 3 of the first, upper encasing body 1 comes down to lie upon the spindle 20 and exerts pressure thereon due to the force exerted by the spring 12. This adds to the force exerted by spring 30 to securely keep the spindle 30 in place. This is necessary because the front end section of the spindle 20 indeed form a part of the front surface 27 of the tobacco-presser, i.e. the front surface 27 of head 13.

After the pressing down of the tobacco arranged in the pipe bowl the smoker's tool is again held in a vertical position, however this time in a position in which the rear end walls of the encasing bodies 1, 2 face the ground. Now again a pressure A is exerted by means of the fingers of the operator such that the encasing bodies 1, 2 spread apart and the tobacco-presser slides back into the housing until it abuts the pivot pins 7 and 8.

If now the spindle 20 is to be used for cleaning the pipe bowl, the tobacco-presser is brought into the position and arrangement as shown in FIG. 3 by executing above outlined operational steps.

In this position of the smoker's tool once more the force A will be brought to bear against the encasing bodies 1, 2 such that they will spread apart. The encasing bodies 1, 2 will now be kept by continuing exertion of said pressure A in their aforementioned spread position. At the same time the tobacco-presser is urged backwards, either by pushing it against a surface or by sliding it back by hand. Thus the tobacco-presser slides back by a small distance into the encasing bodies 1, 2. At the same time the pressure A is released and the upper front end wall 3 of the upper or first, respectively, encasing body 1, resting on the shaft 14 will engage the first notch 24 of the spindle 20. Conclusively the spindle 20 is now locked. Following, the tobacco-presser is pushed back manually or by pressing it against a hard surface, such that it moves out of the position shown in FIG. 4 until the rear surface of the head 13 comes in abutment with both front end walls 3. In this position the tobacco-presser is locked in place by means of the front end wall 3 of the lower, second encasing body 2 exerting a force onto the tobacco-presser. Accordingly, the spindle 20 is now in the operational position for cleaning the pipe bowl.

Should now a longer usable length of the spindle 20 be desired, e.g. in order to clean the pipe bowl from the other side, i.e. by inserting the pipe cleaner spindle into the pipe stem, the spindle 20 can be slid into a second, extended position.

In order to achieve this, the encasing bodies 1, 2 will be spread once more and such, that the front end wall 3 of the upper, first encasing body 1 gives the first notch 24 free. Following this, the spindle 20 can be pulled out further by a short distance (a few millimeters) and the pressure A acting onto the encasing bodies gets released. Then, the spindle 20 is pulled out still further, until the front end wall 3 of the upper, first encasing body 1 enters and locks into the second notch 25 of said spindle. At the same time the nose 26 provided at the rear end of the spindle 20 prevents a slipping out of the tobacco-presser in case the encasing bodies 1, 2 are wrongly kept in their spread position. Now, the entire length of the spindle 20 is available for cleaning the pipe bowl.

After termination of the cleaning of the pipe bowl the spindle 20 will be slid back into the tobacco-presser and the tobacco-presser will slide back into the encasing bodies 1, 2 by operating the smoker's tool as mentioned earlier.

The tobacco-presser is completely encased within said encasing bodies 1, 2 such that no ashes possibly clinging to the head 13 of the tobacco-presser can soil hand and clothes of the user.

Since many modifications, variations and changes in detail may be made to the described embodiments, it is intended that all matter contained in the foregoing description or shown in the accompanying drawings be interpreted as illustrative and not in a limiting sense.

What is claimed is:

1. A smoker's tool comprising an elongated slidable element having axially opposite end portions, means for housing said elongated element, said housing means including a pair of housing bodies which in a first closed position define an elongated chamber for completely housing said elongated element, means for pivoting one of said housing bodies relative to another of said housing bodies for movement between said first closed position and a second open position at which said elongated element projects at least partially beyond said housing means, and cooperative means between at least one of said housing bodies and said elongated element for locking said elongated element in said second position and preventing the sliding return of said elongated element into said chamber.

2. The smoker's tool as defined in claim 1 wherein said cooperative locking means includes a free edge of one of said housing bodies disposed in abutting relationship with a portion of said elongated element.

3. The smoker's tool as defined in claim 1 wherein said elongated element end portions are defined by first and second end portions respectively adjacent and remote from said pivotal connecting means in said first position, and said cooperative locking means are defined at least in part by said elongated element first end portion.

4. The smoker's tool as defined in claim 1 including means for preventing said elongated element from being slid totally beyond said chamber in said second position.

5. The smoker's tool as defined in claim 1 including generally tubular guide means within said chamber for slidably guiding said elongated element.

6. The smoker's tool as defined in claim 1 including generally tubular guide means within said chamber for slidably guiding said elongated element, and said housing bodies being pivotally connected by said pivoting means to said tubular guide means.

7. The smoker's tool as defined in claim 1 including a second elongated slidable element slidably carried by said first-mentioned elongated element, and said cooperative locking means being further operative for locking said second elongated element in said second position and preventing the sliding return of said second elongated element into said chamber.

8. The smoker's tool as defined in claim 1 wherein said elongated element freely slides outwardly of said chamber under the influence of gravity in said second position.

9. The smoker's tool as defined in claim 1 including spring means within said housing means for biasing said housing bodies toward said first position.

10. The smoker's tool as defined in claim 1 wherein said housing free edge is part of a wall of said one housing body disposed remote from said pivotal connecting means.

11. The smoker's tool as defined in claim 1 wherein said housing free edge is part of a wall of said one housing body disposed remote from said pivotal connecting means, and said elongated element portion is a recess.

12. The smoker's tool as defined in claim 1 including a second elongated slidable element slidably carried by said first-mentioned elongated element, said cooperative locking means being further operative for locking said second elongated element in said second position and preventing the sliding return of said second elongated element into said chamber, and said first and second elongated elements being at least in partial telescopic relationship to each other.

13. The smoker's tool as defined in claim 1 wherein said cooperative locking means include a free edge of one of said housing bodies disposed selectively in abutting relationship with a pair of axially spaced portions of said elongated element whereby said elongated element is selectively locked in either of two positions when projecting at least partially beyond said housing means.

14. The smoker's tool as defined in claim 1 including a second elongated element slidably carried relative to said first-mentioned elongated element, and second cooperative locking means for locking said second elongated element in said second position and preventing the sliding return of said second elongated element into said chamber.

15. The smoker's tool as defined in claim 1 including a second elongated element slidably carried relative to said first-mentioned elongated element, and second cooperative locking means for locking said second elongated element in said second position and preventing the sliding return of said second elongated element into said chamber while said first-mentioned cooperative locking means locks said first-mentioned elongated element in said second position.

16. A smoker's tool comprising an elongated slidable element having axially opposite end portions, means for housing said elongated element, said housing means including a pair of elongated housing bodies which in a first closed position define an elongated chamber for housing said elongated element, means for mounting said elongated member for sliding movement at least partially outwardly of said chamber in an open second position of said housing bodies, said housing bodies having axially opposite end portions, pivot means disposed between the axially opposite end portions of one of said housing bodies whereby upon depressing one of said last-mentioned end portions, the end portion remote therefrom moves away from the adjacent housing body to create an opening in said second position through which said elongated element slides to the exterior of said housing means, and said mounting means being operative for effecting the sliding movement of said elongated element completely independent of said pivot means. bodies whereby upon depressing one of said last-mentioned end portions, the end portion remote therefrom moves away from the adjacent housing body to create an opening in said second position through which said elongated element slides to the exterior of said housing means.

17. The smoker's tool as defined in claim 16 wherein said pivot means are disposed between the axially opposite end portions of the other of said housing bodies whereby upon depressing one of said last-mentioned end portions, the end portion remote therefrom moves away from said one housing body to cooperatively create said opening.

18. The smoker's tool as defined in claim 16 wherein said pivot means pivotally connect said one housing body to said mounting means.

19. The smoker's tool as defined in claim 16 wherein said pivot means are disposed between the axially opposite end portions of the other of said housing bodies whereby upon depressing one of said last-mentioned end portions, the end portion remote therefrom moves away from said one housing body to cooperatively create said opening, and said pivot means pivotally connect said one and other housing bodies to said mounting means.

20. The smoker's tool as defined in claim 16 including cooperative means between at least one of said housing bodies and said elongated element for locking said elongated element in said second position and preventing the sliding return of said elongated element into said chamber.

21. The smoker's tool as defined in claim 17 wherein said pivot means pivotally connect said one housing body to said mounting means.

22. The smoker's tool as defined in claim 17 wherein said pivot means are disposed between the axially opposite end portions of the other of said housing bodies whereby upon depressing one of said last-mentioned end portions, the end portion remote therefrom moves away from said one housing body to cooperatively create said opening, and said pivot means pivotally connect said one and other housing bodies to said mounting means.

23. The smoker's tool as defined in claim 17 including cooperative means between at least one of said housing bodies and said elongated element for locking said elongated element in said second position and preventing the sliding return of said elongated element into said chamber.

24. The smoker's tool as defined in claim 16 including spring biasing means for normally biasing said housing bodies to their first closed position independently of the sliding movement of said elongated element.

25. A smoker's tool comprising a pair of relatively slidable elongated elements, means for housing said elongated elements, said housing means including a pair of elongated housing bodies which in a first closed position define an elongated chamber for completely housing said pair of elongated elements, means for relatively moving said pair of housing bodies to a second open position defining an opening through which said pair of elongated elements can pass at least partially outwardly of said chamber, and means between at least one of said housing bodies and either of said elongated elements for selectively locking either of said pair of elongated elements and at least one of said pair of housing bodies to prevent the sliding return of said selectively locked elongated element into said chamber.

26. The smoker's tool as defined in claim 25 wherein said locking means are operative to lock said selectively locked elongated element both when said pair of elongated elements project generally similar and dissimilar distances outwardly of said chamber.

27. The smoker's tool as defined in claim 25 wherein said locking means include a free edge of at least one of said housing bodies disposed in abutting relationship with a portion of said selectively locked elongated element.

28. The smoker's tool as defined in claim 25 wherein said locking means include a free edge of each of said housing bodies disposed in abutting relationship with a portion of at least one each of said pair of elongated elements.

29. The smoker's tool as defined in claim 25 wherein said locking means is operative to lock both of said pair of elongated elements to prevent the sliding return thereof when said pair of elongated elements project generally similar and dissimilar distances outwardly of said chamber.

30. The smoker's tool as defined in claim 25 wherein said pair of elongated elements are at least in partial telescopic relationship to each other.

31. The smoker's tool as defined in claim 25 wherein said pair of elongated members are slidably received in a sleeve, and means for mounting said sleeve within said chamber.

* * * * *